US006032771A

United States Patent [19]

Pedrini

[11] Patent Number: 6,032,771

[45] Date of Patent: Mar. 7, 2000

[54] ARTICLE OF WHEELED LUGGAGE WITH EXTENDIBLE TOWING MEMBER

[75] Inventor: Fabio Pedrini, Bologna, Italy

[73] Assignee: Travel Time Srl, Arenzano, Italy

[21] Appl. No.: 09/016,951

[22] Filed: Feb. 2, 1998

[30] Foreign Application Priority Data

Feb. 7, 1997 [IT] Italy ..... T097A0094

[51] Int. Cl.[7] ..... A45C 5/14; A45C 13/26

[52] U.S. Cl. ..... 190/18 A; 190/39; 190/115; 16/115

[58] Field of Search ..... 190/18 A, 115, 190/39; 16/115; 280/37

[56] References Cited

U.S. PATENT DOCUMENTS

| | | | |
|---|---|---|---|
| 1,197,190 | 9/1916 | Dunn et al. | 190/18 A X |
| 3,275,336 | 9/1966 | Warner, Jr. | 190/115 X |
| 3,522,955 | 8/1970 | Warner, Jr. | 190/18 A X |
| 3,572,870 | 3/1971 | Marks | 190/39 X |
| 4,759,431 | 7/1988 | King et al. | 190/115 X |
| 4,792,025 | 12/1988 | Thomas | 190/18 A |
| 5,048,649 | 9/1991 | Carpenter et al. | 190/115 X |
| 5,111,918 | 5/1992 | Bako et al. | 190/18 A |
| 5,330,037 | 7/1994 | Wang | 190/115 X |
| 5,355,980 | 10/1994 | Hsieh | 190/115 |
| 5,407,038 | 4/1995 | Pedlar | 190/18 A |
| 5,447,217 | 9/1995 | Chou | 190/115 X |
| 5,513,873 | 5/1996 | Chen | 16/115 X |
| 5,560,458 | 10/1996 | Franklin et al. | 190/18 A X |
| 5,581,847 | 12/1996 | Hsieh | 190/115 X |
| 5,615,757 | 4/1997 | Chen | 190/115 |
| 5,630,488 | 5/1997 | Chen | 190/115 |
| 5,762,169 | 6/1998 | Deliman et al. | 190/102 X |
| 5,816,374 | 10/1998 | Hsien | 190/115 |

FOREIGN PATENT DOCUMENTS

| | | | |
|---|---|---|---|
| 6205704 | 7/1994 | Japan | 190/18 A |

*Primary Examiner*—Sue A. Weaver

*Attorney, Agent, or Firm*—Sughrue, Mion, Zinn Macpeak & Seas, PLLC

[57] ABSTRACT

An article of luggage comprises a main body provided with an upper handle for gripping and carrying the article of luggage, and with lower wheels. It is further provided with an extendible towing member, for towing the article of luggage on the wheels, this member being slidably mounted between a retracted inoperative position and an extended operative position. The whole body of the main handle forms part of said extendible towing member, so that the whole main handle acts also as towing handle of the article of luggage when the towing member is in its extended position.

8 Claims, 5 Drawing Sheets

50
180
210
180

2
14
180
2b
50
200
210
211
180

14
IX
IX
12
50
210
211
2b
180
200
220
2a

ARTICLE OF WHEELED LUGGAGE WITH EXTENDIBLE TOWING MEMBER

BACKGROUND OF THE INVENTION

The present invention relates to articles of luggage of the known type comprising:

a main body, defining an interior containing space, which is provided with an outer main handle for gripping and carrying the article of luggage, as well as with lower wheels, and an extendible towing member, for towing the article of luggage on said wheels, said member being slidably mounted on a rigid portion of said main body between a retracted inoperative position and an extended operative position.

An article of luggage of the above indicate type is described and shown for example in International patent application WO96/20620. This document shows a suitcase for use as a hand luggage during a travel by plane, wherein the above-mentioned extendible towing member has an auxiliary handle, separate from the main handle of the suitcase, which is used for towing and driving the suitcase on its wheels.

SUMMARY OF THE INVENTION

The object of the present invention is that of providing an article of luggage of the type indicated at the beginning, which has an extremely simple and inexpensive structure, while being extremely efficient in use.

In view of achieving this object, the invention provides an article of luggage of the above indicated type, characterized in that the whole body of said main handle forms part of said extendible towing member, so that the whole main handle acts as towing handle of the article of luggage when said towing member is in its extended position.

In a preferred embodiment of the invention, wherein said main body of the particle of luggage has two opposite main walls, two end walls, a bottom wall and a top wall, and wherein said wheels are rotatably supported around an axis substantially parallel to the main walls, the invention is further characterized in that said towing member is slidably mounted within a guiding passage formed in a main wall of the body of the article of luggage and has an upper end forming said handle which is arranged in a plane spaced apart from the plane of said guiding passage, so that in the retracted condition of the towing member, the handle is arranges centrally on said top wall, i.e. in a position spaced from both the main walls. Due to this feature, said handle may fulfil efficiently both the function of towing handle, when the towing member is extended, and the function of main handle, for lifting and carrying the article of luggage, when the towing member is in a retracted condition.

The above-mentioned main body of the article of luggage is provided with latching means adapted to lock said towing member in its retracted position. In said preferred embodiment, said latching means comprises at least one hook member carried by said main body and biassed by spring means towards a position of engagement on a co-operating shoulder surface formed on the towing member, and an unlatching lever, also carried by the main body and operatively connected to said hook member, said unlatching lever being movable, against the action of said spring means biassing the hook member, towards a position in which it causes disengagement of the hook member from the corresponding shoulder surface.

Preferably, said unlatching lever is pivotally mounted on the main body and has two side wings which control two respective hook members pivotally mounted on the main body and on their turn co-operating with two respective shoulder surfaces formed on two opposite arms of the towing member which project longitudinally from the upper end of the latter and are connected transversally by a bridge-like body forming said handle.

In a particularly preferred embodiment, said hook member and said unlatching lever are made in one piece.

Due to the above indicated features, the article of luggage according to the invention is extremely efficient in use while having a structure extremely simple to manufacture and assemble, and therefore of low cost.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
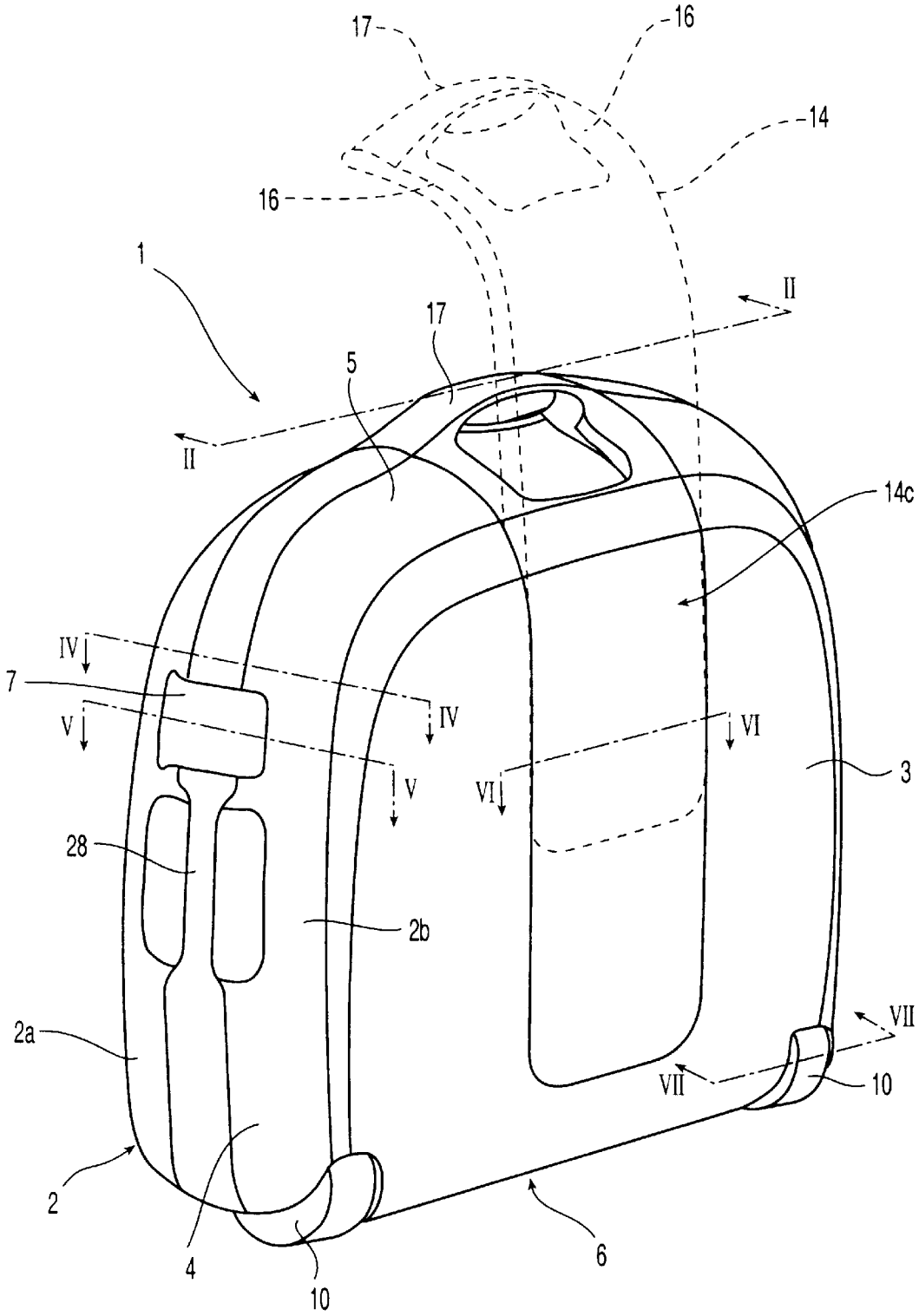
FIG. 1 is a perspective view of a suitcase according to the present invention.
Figure 3:
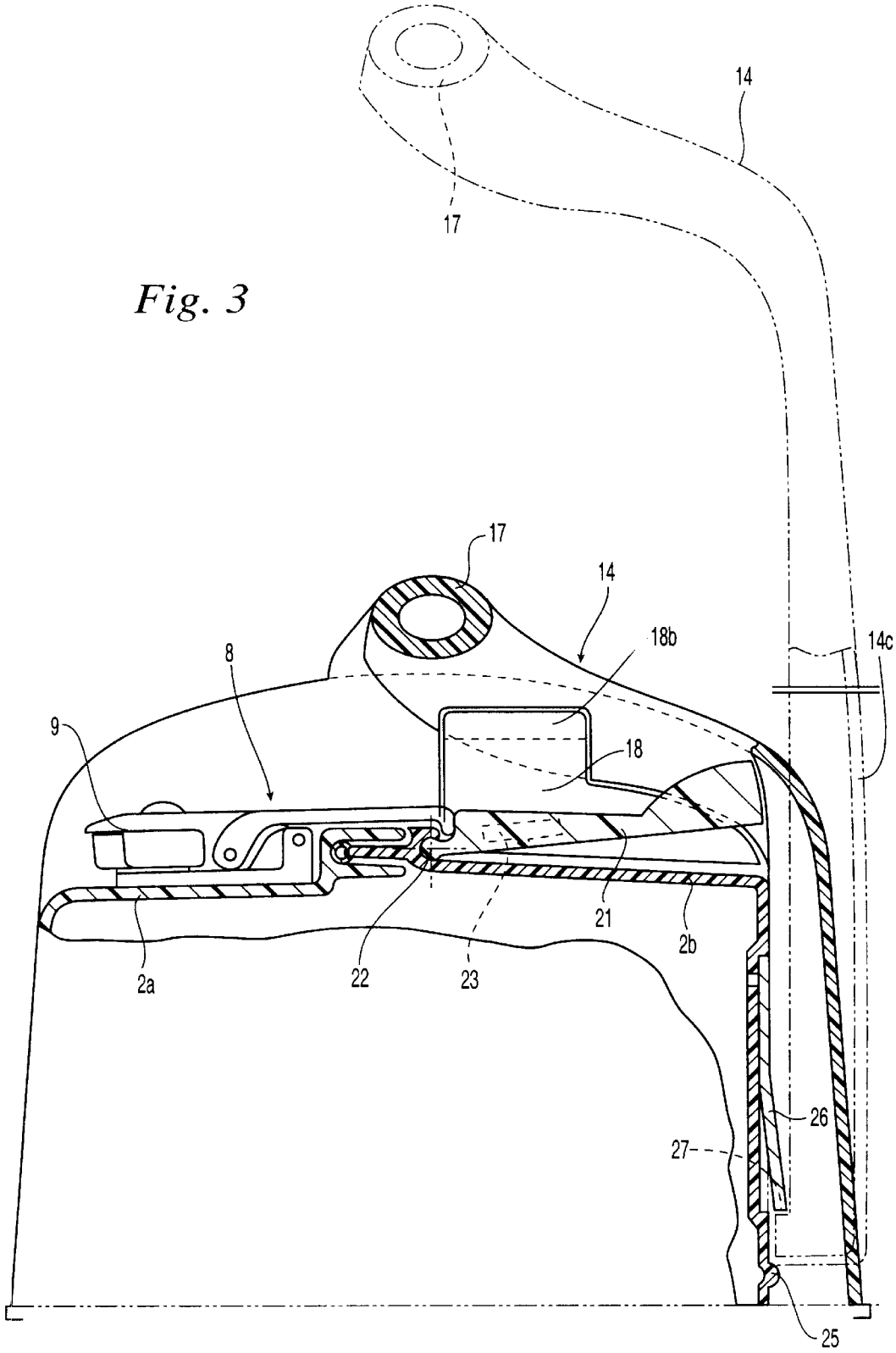
FIG. 3 is a view in cross-section taken along line III—III of FIG. 2, FIGS. 4, 5, 6 are cross-sections taken along lines IV—IV, V—V and VI—VI of FIG. 1.

Referring to the drawings, numeral 1 generally designates a suitcase which can be used for example as hand luggage during a travel by plane, comprising a main body 2, for example of a rigid plastic material, having two opposite main walls 3 (only one of which is visible in FIG. 1), two end walls 4 (only one of which is visible in FIG. 1), an upper wall 5 and a lower wall 6 (not visible in FIG. 1). According to a technique which is conventional per se, the main body 2 is made by two half-shells 2*a*, 2*b* articulated to each other at the lower wall 6 and defining an interior containing space. The two half-shells 2*a*, 2*b* are mutually engaged along their peripheral edge in the closed condition shown in FIG. 1 and can be locked in this condition by means of two toggle locking devices 7 (only one of which is visible in FIG. 1) at the two end walls 4, and a further toggle locking device 8 (FIG. 3) at the top wall 5, provided with a lock 9. The toggle locking devices 7, 8, as well as the lock 9, are shown only diagrammatically in the drawings and are not described herein, since they can be made in any known way and do not fall, taken alone, within the scope of the invention. The elimination of the details of construction of these devices from the drawings also renders the latter easier and simpler to understand.

The body of the suitcase 1 is provided at its bottom with two wheels 10 freely rotatably mounted around an axis 11

Figure 7:
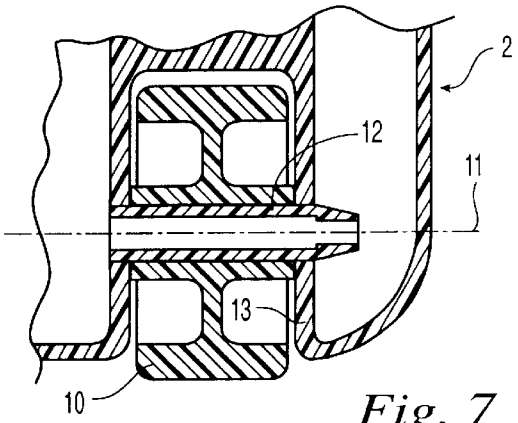
FIG. 7 is a view in cross-section taken along line VII—VII of FIG. 1.

(FIG. 7) parallel to the general plane of the two main walls 3. As shown in FIG. 7, each wheel 10 is freely rotatably mounted on a pin 12 of plastic material which on its turn is mounted by snap engagement into body 2 of the suitcase, which locally has a seat 13 for receiving the respective wheel 10.

Figure 6:
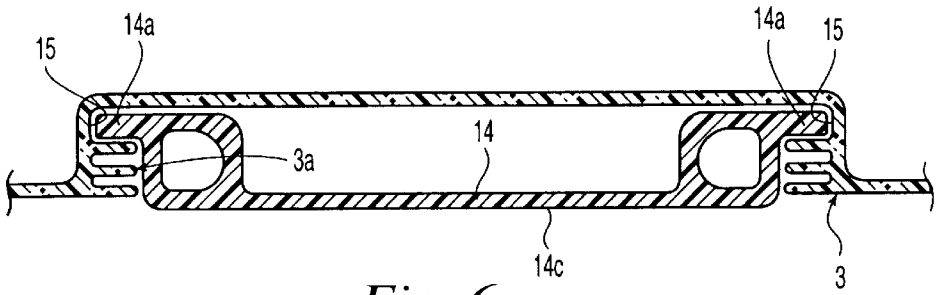

With reference to FIGS. 1, 6, one of the two main walls 3 centrally has a guiding passage 3*a* recessed therein within which there is slidably mounted a member 14 which is extendible to the position shown by dotted lines in FIG. 1, for towing the suitcase 1 on wheels 10.

In the embodiment which is shown, the auxiliary towing member 14 is constituted by a flattened and elongated body of plastic material, having two side wings 14*a* engaging two respective recesses 15 of the guiding passage 3*a*with the outer surface 14*c* of the towing member exposed.

The towing member 14 ends at its top with two arms 16 projecting longitudinally and curved, these arms being connected to each other by a bridge-like body 17 which forms the main handle of the suitcase 1. The towing member 14 is movable between a retracted inoperative position, shown by undotted lines in FIG. 1, in which the handle 17 forms the main handle of the suitcase, to be used for lifting and carrying the suitcase, and a raised operative position (indicated by dotted lines in FIG. 1) in which the handle 17 forms the handle for gripping the towing member 14, for towing the suitcase 1 on wheels 10.

Figure 2:
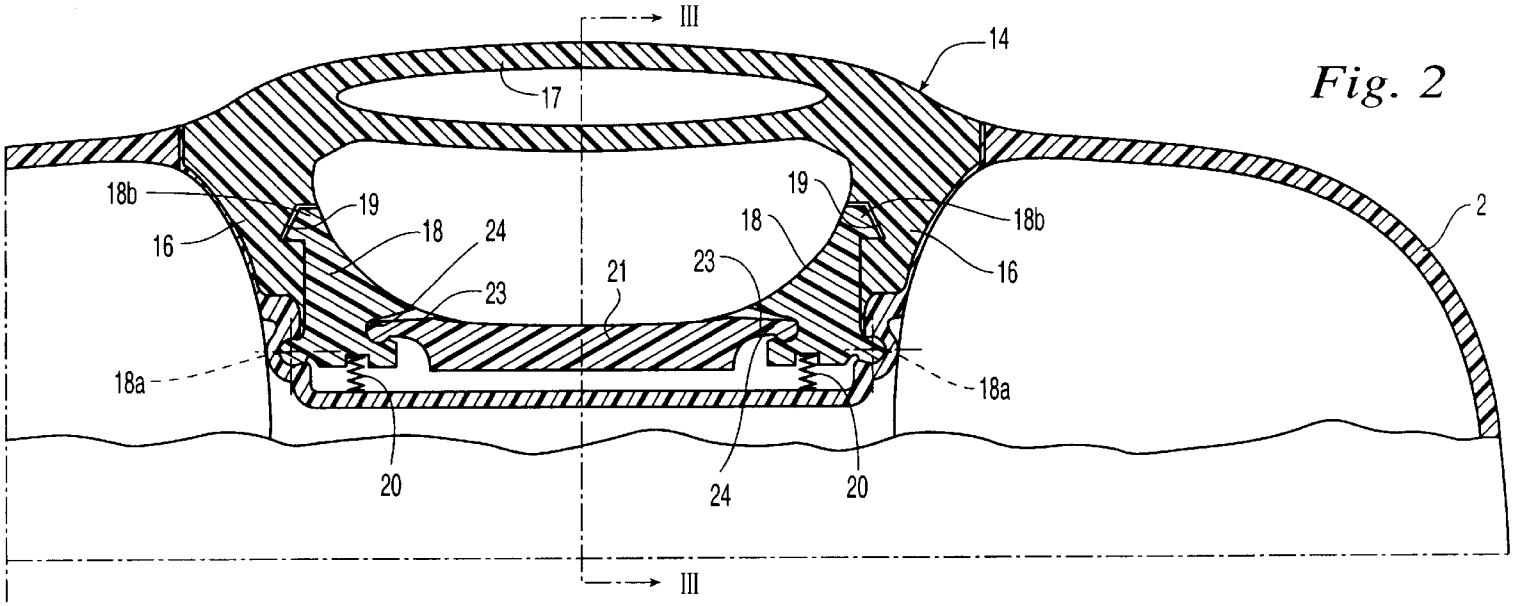
FIG. 2 is a view in cross-section at an enlarged scale taken along line II—II of FIG. 1.

The embodiment shown in the drawings has two latching levers 18 for locking the towing member 14 in its retracted inoperative position. The levers 18 are pivotally mounted around axes 18*a* (FIG. 2) on the main body 2 of the suitcase and have hook-shaped ends 18*b* adapted to engage receiving surfaces 19 formed on the two arms 16 forming part of the towing member 14. As shown in FIG. 2, the articulation of the levers 18 on the body of the suitcase is obtained by fitting a bead of circular cross-section projecting from the body of each lever 18 into a seat of mating cross-section formed in the body of the suitcase. This solution thus enables said articulation to be provided in a simple and inexpensive way, and with no need of additional parts. The two latching levers 18 can be moved away from their engaging position shown in FIG. 2 by pressing an unlatching lever 21 downwardly, against the action of springs 20. The lever 21 is articulated around an axis 22 on the body of the suitcase 2 and has two side wings 23 received within respective cavities 24 of the latching levers 18 so as to be operatively connected to these levers 18. By pressing lever 21 downwardly, the two hooks 18*b* come out of engagement from the respective seats 19 and enable the towing member 14 to be extended. In the fully extended condition, the member 14 is prevented from falling by a projection 25 of body 2 of the suitcase (FIG. 3) which is overcome by the structure of member 14, whereas full removal thereof from the suitcase is prevented by a spring leaf 26 which enters into abutment against a surface 27 of member 14 (see also FIG. 3). When member 14 is lowered again until it reaches its retracted condition, the two levers 18 snap into engagement within the respective seats, under the action of springs 20.

As shown, the structure of the suitcase according to the invention is characterized by a great simplicity of construction and assembling, has a reduced number of parts and in spite of this is extremely efficient in use. In particular, an essential feature of the invention lies in that the whole body of the handle 17 forms part of the auxiliary member 14, so that this handle is used both as main handle of the suitcase 1, for gripping and lifting the suitcase when the member 14 is retracted, and as a towing handle, when the member 14 is extended.

Only by way of example, FIG. 1 shows an embodiment in which the suitcase has an auxiliary handle 28 on one of the two end walls 4, which can also be used for lifting the suitcase.

Figure 5:
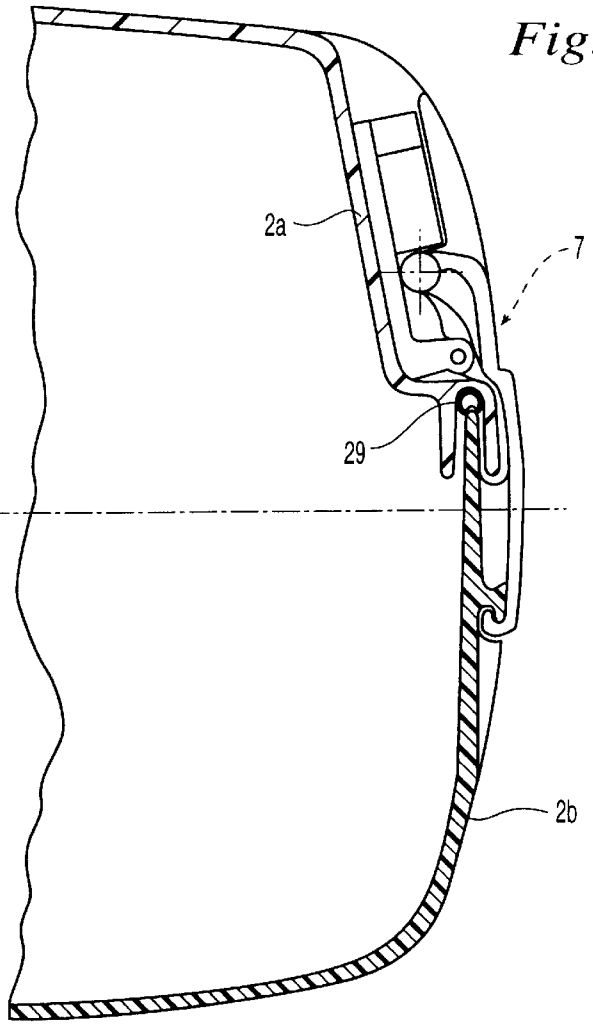
Figure 4:
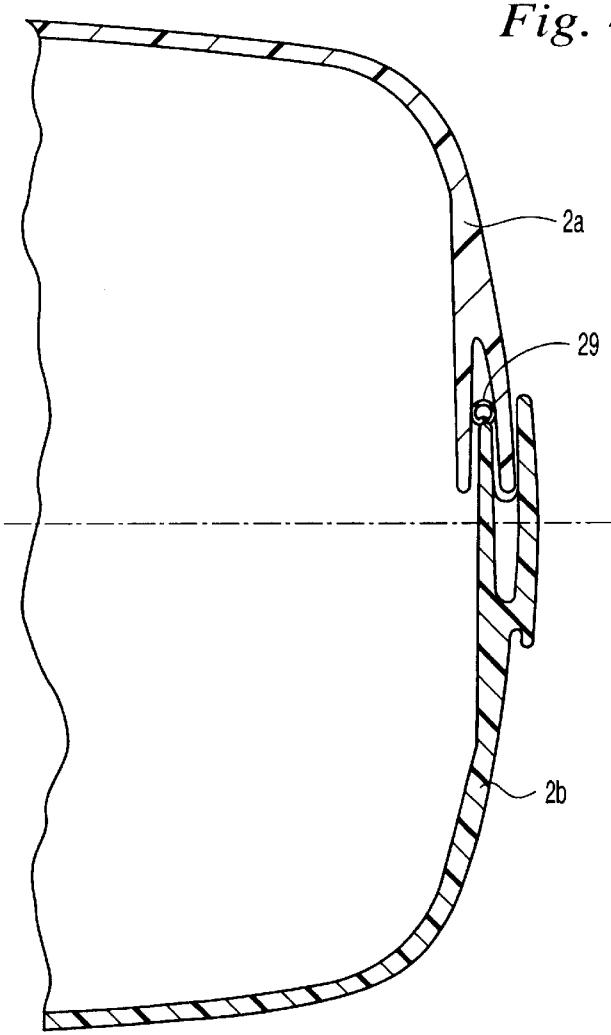

FIGS. 4, 5 show the detail of the profile in cross-section of the two half-shells 2*a*, 2*b*, whose peripheral edges in mutual engagement have a shape such as to define a labyrinth seal with the interposition of a rubber sealing strip 29. FIG. 5 shows the detail of the locking device 7 which, as already indicated above, is not described herein since it can be made in any known way and since this device does not fall, taken alone, within the scope of the invention.

Figures 8, 9, 10:
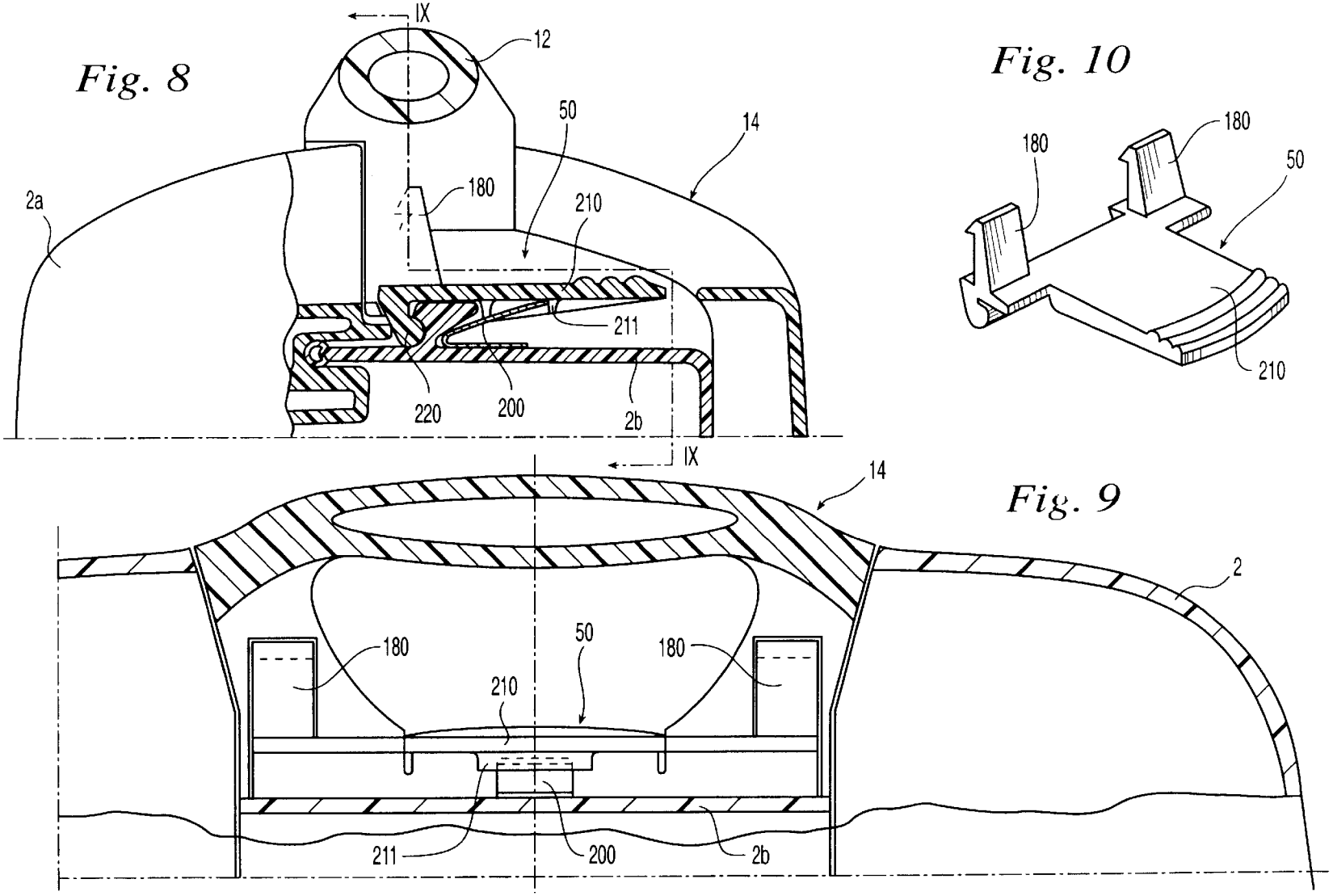
FIG. 8 is a variant of FIG. 3, which relates to a further embodiment.
FIG. 9 is a view in cross-section taken along line IX—IX of FIG. 8.
FIG. 10 is a perspective view of a detail of the suitcase of FIGS. 8, 9.

FIGS. 8, 9 show a further embodiment of the invention which differs from that described above essentially in that it has a body 50, shown in perspective view in FIG. 10, in which two latching levers 180 and an unlatching lever 210 are integrated in one piece. Furthermore, this body is pivotally mounted on the half-shell 2*b* of the suitcase around an axis which is parallel, rather than perpendicular, to the main walls of the suitcase, by means of the engagement of a rib 220 having a circular cross-section, forming integral part of this body, into a cavity of similar cross-section formed in the half-shell 2*b*. The body 50 is subject to the action of a V-shaped leaf spring 200, which is inserted between the facing surfaces of the half-shell 2*b* and lever 210, until they snap past a tooth 211 of lever 210. The spring 200 biasses the two latching levers towards a position for latching the extendible member 14 and is deformed when unlatching of this member is caused by pressing lever 210. The solution shown in FIGS. 8–10 is therefore further simplified.

Naturally, while the principle of the invention remains the same, the details of construction and the embodiments may widely vary with respect to what has been described and illustrated purely by way of example, without departing from the scope of the present invention.

What is claimed is:

1. Article of luggage, comprising:

a main body, defining an interior containing space, which is provided with an outer main handle for gripping and carrying the article of luggage, as well as with lower wheels, and an extendible towing member, for towing the article of luggage on said wheels, said member being slidably mounted on a rigid portion of said main body between a retracted inoperative position and an extended operative position, wherein the whole body of said main handle forms part of said extendible towing member, so that the whole main handle acts also as towing handle of the article of luggage when said towing member is in its extended position, wherein said main body has two opposite main walls, two end walls, a bottom wall and a top wall, wherein said wheels are rotatably supported around an axis substantially parallel to the main walls, and wherein said towing member is a flattened elongated element slidably mounted within a guiding passage recessed in an outer surface of one main wall of the body of the article of luggage and has an upper end curved over said top wall and forming said handle, which is arranged in a plane spaced from the plane of said guiding passage, so that in the retracted condition of the towing member, the handle is arranged centrally on said top wall, said guiding passage having recesses in opposite sides thereof for slidably retaining said towing member in said guiding passage with said towing member having an outer exposed surface in the retracted condition of the towing member.

2. Article of luggage according to claim 1, wherein said main body is provided with latching means adapted to lock said towing member in its retracted position.

3. Article of luggage according to claim 2, wherein said latching means comprises at least one hook member carried by said main body and biassed by spring means towards a position of engagement of a co-operating shoulder surface formed on the towing member, and an unlatching lever, also carried by the main body and operatively connected to said hook member, said unlatching lever being movable, against the action of said spring means biassing the hook member, towards a position in which it causes disengagement of the hook member from the co-operating shoulder surface.

4. Article of luggage according to claim 3, wherein said unlatching lever is pivotally mounted on the main body and has two side wings which control two respective hook members, pivotally mounted on the main body and on their turn co-operating with two respective shoulder surfaces formed on two opposite arms of the towing member which project longitudinally from the upper end of the latter and are connected transversally by a bridge-like body forming said handle.

5. Article of luggage according to claim 4, wherein said hook members are articulated around respective axes perpendicular to the main opposite walls of said article of luggage, whereas the unlatching lever is articulate around an axis parallel to said walls.

6. Article of luggage according to claim 4, wherein said unlatching lever and said hook members are formed in one piece.

7. Article of luggage according to claim 6, wherein the body including said unlatching lever and said hook members is pivotally mounted on the main body around an axis parallel to said opposite main walls.

8. Article of luggage according to claim 1, wherein means are provided for locking the towing member in its extended condition.

* * * * *